US008093551B2

(12) United States Patent
King

(10) Patent No.: US 8,093,551 B2
(45) Date of Patent: Jan. 10, 2012

(54) SELF-ALIGNING FLOATING ION-OPTICS COMPONENTS

(75) Inventor: Douglas J. King, Union City, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 287 days.

(21) Appl. No.: 12/492,159

(22) Filed: Jun. 26, 2009

(65) Prior Publication Data

US 2010/0327156 A1 Dec. 30, 2010

(51) Int. Cl.
*H01J 49/06* (2006.01)

(52) U.S. Cl. ..... 250/281; 250/282; 250/289

(58) Field of Classification Search ..... 250/281–300
See application file for complete search history.

(56) References Cited

U.S. PATENT DOCUMENTS 363,659 A * 5/1887 Bylicki ..... 206/480
4,279,195 A 7/1981 Miller
4,328,420 A * 5/1982 French ..... 250/282
5,083,021 A * 1/1992 Devant et al. ..... 250/292
5,268,572 A 12/1993 Mordehai
5,628,148 A * 5/1997 Beutler ..... 49/394
5,753,795 A 5/1998 Kuypers
6,069,355 A 5/2000 Mordehai
7,112,787 B2 9/2006 Mordehal
7,329,865 B2 2/2008 Kuypers

OTHER PUBLICATIONS

"Ion optics innovations for increased sensitivity in hybrid MS systems", 5989-7408EN, Technical Overview, Agilent Technologies, Inc., printed in the U.S.A. Oct. 31, 2007.

* cited by examiner

*Primary Examiner* — Jack Berman

(57) ABSTRACT

A mass spectrometry system includes an ion-optics and a housing for the ion-optics. A panel is movable between an open and closed position relative to the housing. A first section of the ion-optics is within the housing, while a second section of the ion-optics is mounted to the panel. The ion-optics is surrounded by the housing and the panel when the panel is in the closed position. An alignment mechanism aligns the first and second sections of the ion-optics into a pre-determined alignment upon closing the panel.

19 Claims, 7 Drawing Sheets

SELF-ALIGNING FLOATING ION-OPTICS COMPONENTS

BACKGROUND OF THE INVENTION

Mass spectrometry is an analytical technique that can be used to identify the chemical composition of a sample based on the mass-to-charge (m/z) ratio of charged particles. A sample comprises charged particles or undergoes ionization to form charged particles. The ratio of charge to mass of the particles is typically determined by passing them through electric and magnetic fields in a mass spectrometer.

Mass spectrometry has both qualitative and quantitative uses, such as identifying unknown compounds, determining the isotopic composition of elements in a compound, determining the structure of a compound by observing its fragmentation, quantifying the amount of a compound in a sample, studying the fundamentals of gas phase ion chemistry (the chemistry of ions and neutrals in a vacuum), and determining other physical, chemical, or biological properties of compounds.

FIG. 1 shows an example of ion-optics 100 of a typical triple quadrupole mass spectrometer system. The ion-optics 100 of a mass spectrometer generally has three main modules: an ion source 101, which transforms the molecules in a sample into ions 113; a mass analyzer 103, which sorts the ions 113 by their mass-to-charge ratios by applying electric and magnetic fields; and a detector 105, which measures the value of some indicator quantity and thus provides data for calculating the abundances of each ion present.

In the case of a triple quadrupole mass spectrometer, the mass analyzer 103 has a series of three quadrupoles. A first quadrupole 107 and a third quadrupole 111 act as mass filters. A middle quadrupole 109 is included in a collision cell. This collision cell uses gas to induce fragmentation (collision induced dissociation) of selected precursor ions from the first quadrupole 107. Subsequent fragments are passed through to the third quadrupole 111 where they may be filtered or scanned fully.

The use of the three quadrupoles allows for the study of fragments (product ions), which is very helpful in structural elucidation. For example, the first quadrupole 107 may be set to "filter" for an ion of a known mass, which is fragmented in the middle quadrupole 109. The third quadrupole 111 can then be set to scan the entire m/z range, giving information on the sizes of the fragments made. Thus, the structure of the original ion can be deduced.

Sometimes components of the ion-optics 100 can become dirty, malfunction, or might require regular periodic maintenance, and therefore must be accessed or removed by a user. However, it is inconvenient to access or remove ion-optics components from prior-art mass spectrometers. For example, certain mass spectrometers (e.g. U.S. Pat. No. 6,069,355) have separate vacuum chambers and standard vacuum connections, making it very difficult and time consuming to access or remove components internal to the vacuum chambers. Additionally, components of the ion-optics 100 must be precisely positioned and aligned with each other when reassembled inside the mass spectrometer.

In the prior-art, internal components are often aligned using alignment systems, such as rails, to which all of the internal components are mounted. Other alignment systems make use of a precision machined chamber into which the internal components are inserted. The liquid chromatography triple quadrupole mass spectrometer instrument (LC/QQQ) by AGILENT TECHNOLOGIES, INC, is an example of a mass spectrometer making use of such alignment techniques.

However, in these prior-art alignment systems, parts of the alignment systems can be far apart compared to the components that are to be aligned. This can lead to problems with tolerance stack-up and difficult-to-achieve machining tolerance requirements, causing such systems to be more complex and expensive to fabricate. Here tolerance stack-up, also known as tolerance stack or tolerance stackup, is a term used to describe the variation that occurs as a result of the accumulation of specified dimensions and tolerances.

It would be desirable to provide fast and convenient access to mass spectrometer components while at the same time allowing for the components to be reassembled with precise positioning and alignment.

BRIEF DESCRIPTION OF THE DRAWINGS

Further preferred features of the invention will now be described for the sake of example only with reference to the following figures, in which.

DETAILED DESCRIPTION

Figure 1:
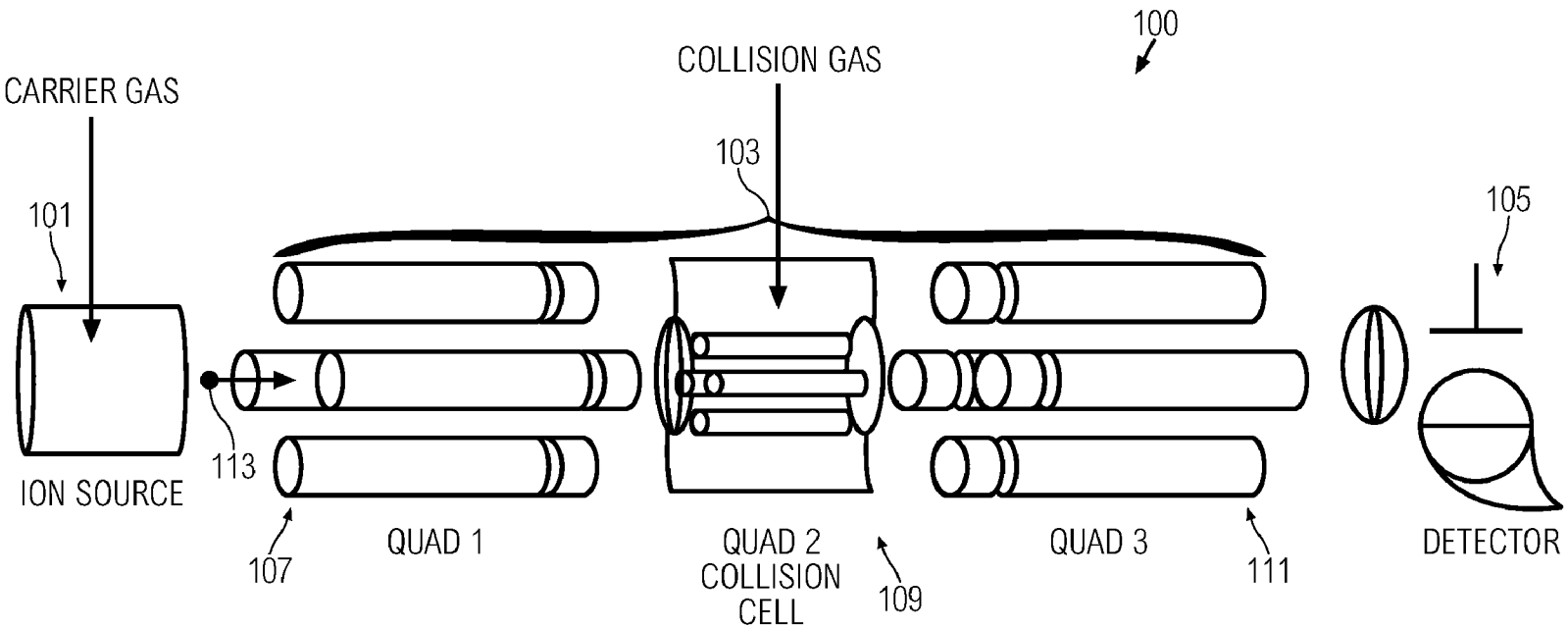
FIG. 1 (PRIOR ART)
FIG. 1 is a schematic diagram illustrating ion-optics of a typical triple quadrupole mass spectrometer system of the prior art.
Figure 2:
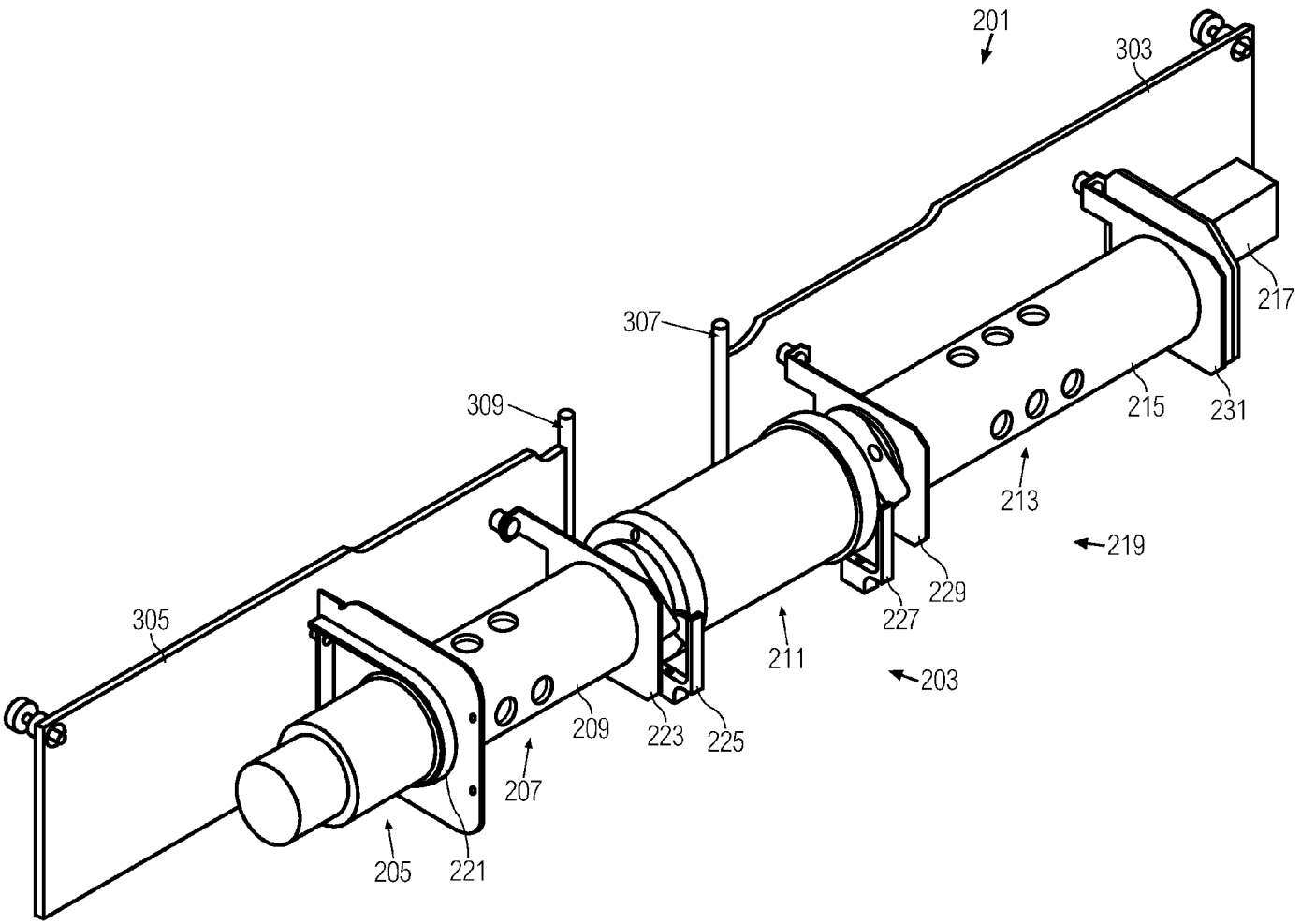
FIG. 2 illustrates the positions of the ion-optics and panels when the panels are closed relative to a housing of a triple quadrupole mass spectrometer system of the present invention.
Figure 3:
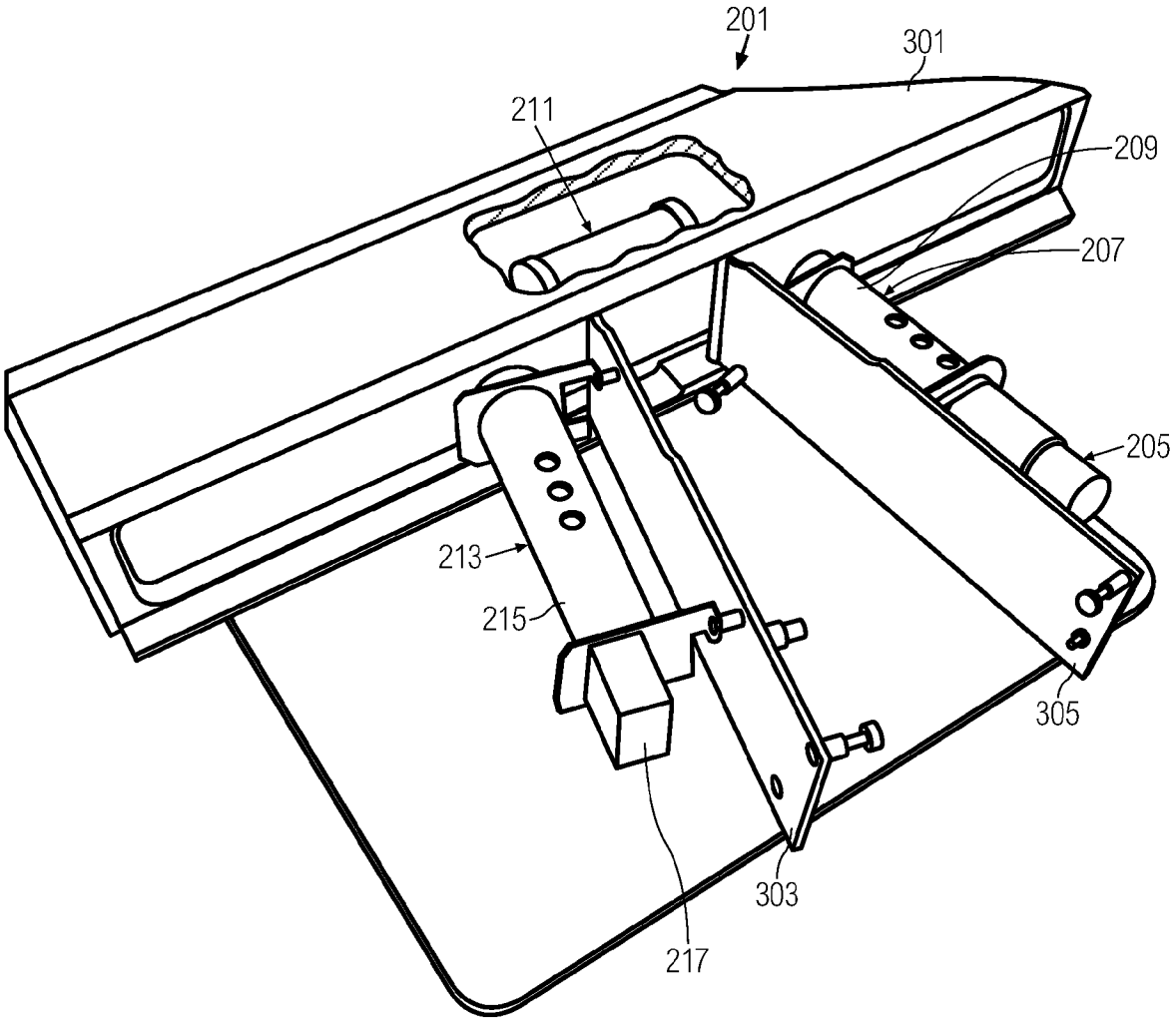
FIG. 3 illustrates the panels in an open position relative to the housing.

In an embodiment of the present invention, a mass spectrometry system 201 (FIG. 2) provides fast and convenient access to an ion-optics 203 when panels 303, 305 are opened relative to a housing 301 (FIG. 3). The components of the ion-optics 203 are mounted to the panels 303, 305 and the housing 301, but by opening the panels 303, 305, the components can easily be separated from each other, from the panels 303, 305 and from the housing 301. An alignment mechanism 401 (FIGS. 4, 5 and 8) of the present invention makes it a simple matter to achieve precise positioning and alignment of the ion-optics 203 when it is reassembled within the housing 301 by closing the panels 303, 305.

Describing the figures in more detail, in FIG. 2, positions of the ion-optics 203 and panels 303, 305 are shown with the panels 303, 305 closed relative to the housing 301. The housing 301 is removed to more clearly view the ion-optics 203. When the mass spectrometry system 201 is to be used, the panels 303, 305 are positioned in the closed position relative to the housing 301 so that the ion-optics 203 is surrounded by or within the housing 301.

The ion-optics 203 is shown to include an ion source 205, a first quadrupole mass filter 207 within a cylindrical shroud 209, a middle quadrupole collision cell 211, a third quadrupole mass filter 213 within a cylindrical shroud 215 and a detector 217. The first quadrupole mass filter 207, middle quadrupole collision cell 211 and third quadrupole mass filter 213 combine to form a mass analyzer 219.

Any one or combination of the components 205-217, or any other components through which the ions pass (the path the ions 113 take can be referred to as an "ion-beam path" or "beam path") when traveling from the ion source 205 to the detector 217, can be referred to as the ion-optics 203.

FIG. 3 shows the panels 303, 305 in an open position relative to the housing 301. The housing is shown cut away at the top to provide a view of the middle quadrupole collision cell 211. The first panel 303 and the second panel 305 (shown in both FIG. 2 and FIG. 3) provide access to the ion-optics 203 within the housing 301. The panels 303, 305 are connected to the housing 301 via hinges 307, 309 (FIG. 2), respectively. The panels 303, 305 rotate about the hinges 307, 309 when moving between open and closed positions relative to the housing 301.

Although the panels 303, 305 are described as being open or closed by rotating the panels 303, 305 about the hinges 307, 309, alternately, the panels 303, 305 can be opened or closed by sliding them into the open or closed position, or in other ways as would be appreciated by those skilled in the art.

Portions of the ion-optics 203 are mounted directly or indirectly to any combination of, or all of, the panels 303, 305 and housing 301. In other embodiments, different devices, including electron microscopes, sample handlers for electron microscopes, surface science equipment, or wafer loaders may be mounted to the panels 303, 305 and/or housing 301. Electronic subassemblies may also be mounted to the panels 303, 305 and/or housing 301.

FIGS. 2 and 3 additionally illustrate the ion source 205 and the first quadrupole mass filter 207 within the cylindrical shroud 209 mounted to, and fixed relative to, the panel 305 using brackets 221, 223. More specifically, the cylindrical shroud 209 is rigidly fixed to the brackets 221, 223 which in turn are rigidly fixed to the panel 305.

Similarly, the third quadrupole mass filter 213 within the cylindrical shroud 215 and the detector 217 are shown to be mounted to, and fixed relative to, the panel 303 using brackets 229, 231.

Figure 9:
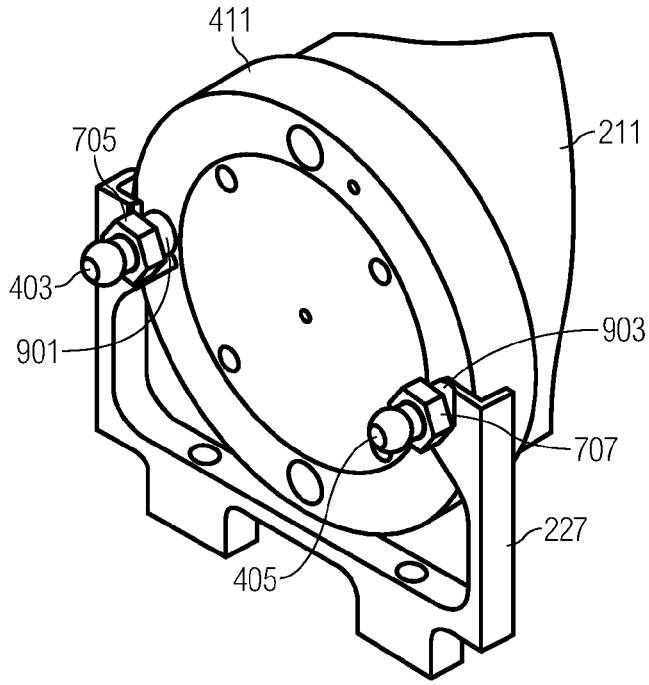
FIG. 9 shows a bracket supporting the middle quadrupole collision cell.

As shown in FIG. 2, the middle quadrupole collision cell 211 is mounted to the housing 301 using the brackets 225, 227. FIG. 9 shows in greater detail the bracket 227 supporting the middle quadrupole collision cell 211. The middle quadrupole collision cell 211 loosely rests on the bracket 227 rather than being rigidly constrained by it. The opposite end of the middle quadrupole collision cell 211 loosely rests on the bracket 225 in a similar manner. The use of this arrangement of the middle quadrupole collision cell 211 and the brackets 225, 227 is described in greater detail below.

The brackets 221, 223 are mounted to positions on the panel 305, the brackets 225, 227 are mounted to positions on the housing 301, and the brackets 229, 331 are mounted to positions on the panel 303 such that the ion-optics 203 is assembled into a predetermined alignment when attached to the brackets 221, 223, 225, 227, 229, 331 and when the panels 303, 305 are in the closed position relative to the housing 301.

In general the components of the ion-optics can be mounted to the panels 303, 305 and the housing 301 either directly, indirectly, or using any attachment means as would be understood by those skilled in the art. The mounting can provide fixed, rigid support, or alternatively can provide loose support. The mounting can constrain the components of the ion-optics in all or some directions of motion.

There are tight positioning and alignment requirements for the components forming the ion-optics 203. Thus, the ion-optics 203 of the present invention is manufactured from components that will align with each other with high precision to meet these requirements. The components of the ion-optics 203, including the ion source 205, first quadrupole mass filter 207, middle quadrupole collision cell 211, third quadrupole mass filter 213 and detector 217, should all be aligned radially (perpendicular to the beam path) and positioned axially (in the direction of the beam path) to within 0.5 millimeters of the design specifications. In some systems the alignment tolerance is much less than 0.5 millimeters of the design specifications requiring the components of the present invention to achieve even more precise alignment and positioning.

It should be noted that in this description, the alignment and positioning of the ion-optics 203 is described with reference to a cylindrical coordinate system having its axial component along the beam path, its radial component perpendicular to the beam path, and its tangential components circling the beam path.

Figure 4:
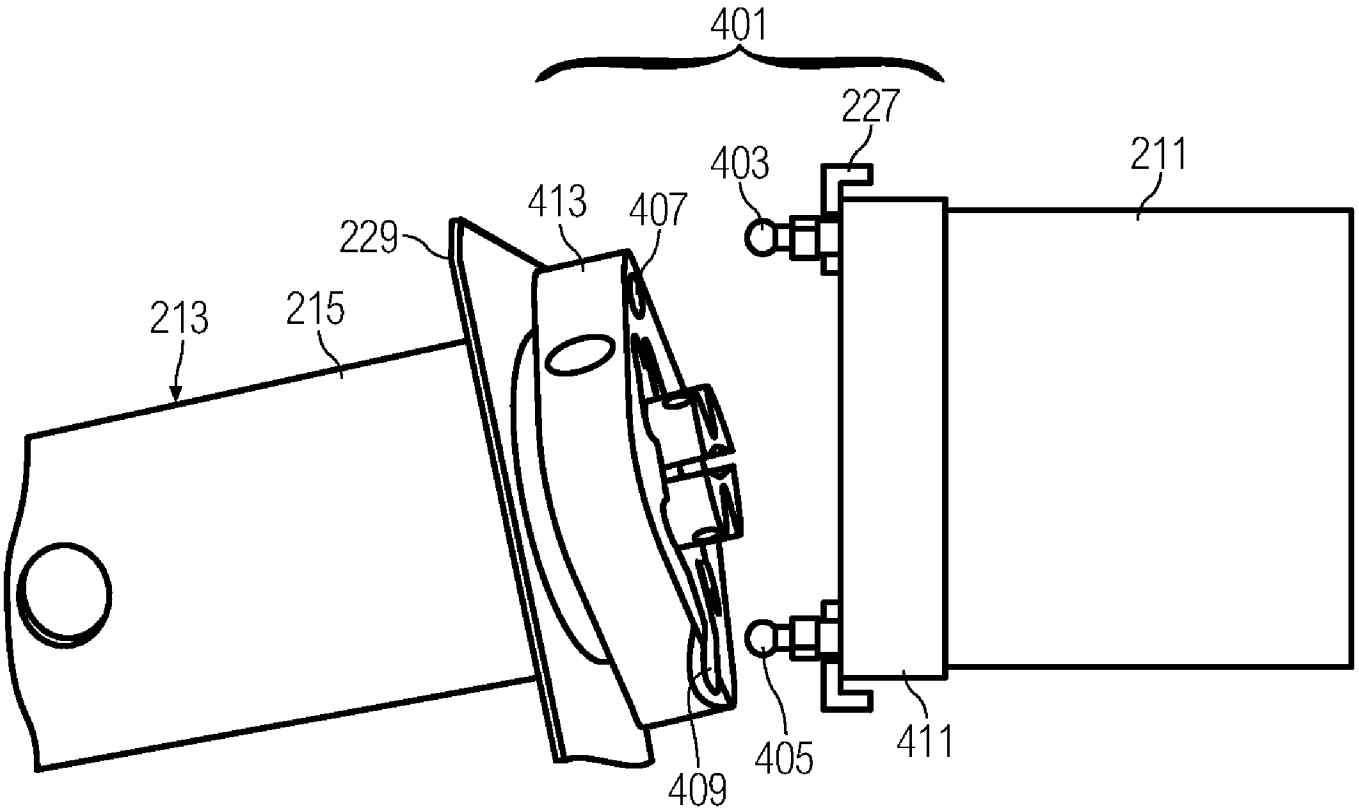
FIG. 4 shows a close-up-view of an alignment mechanism between a middle quadrupole collision cell and a quadrupole mass filter within a cylindrical shroud.
Figure 5:
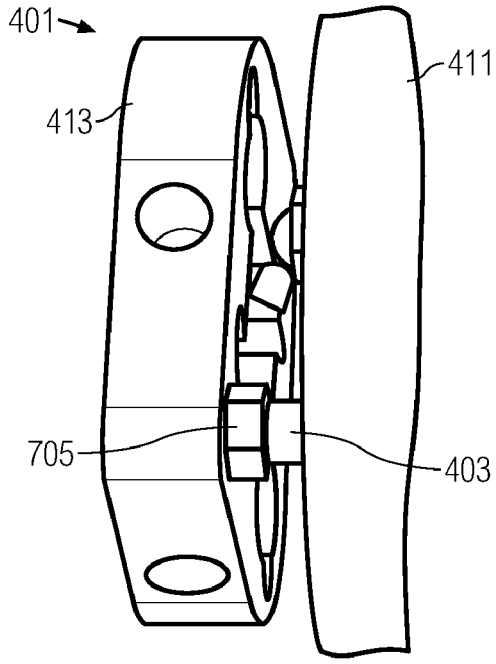
FIG. 5 shows the alignment mechanism with the quadrupole mass filter and middle quadrupole collision cell placed together.
Figure 8:
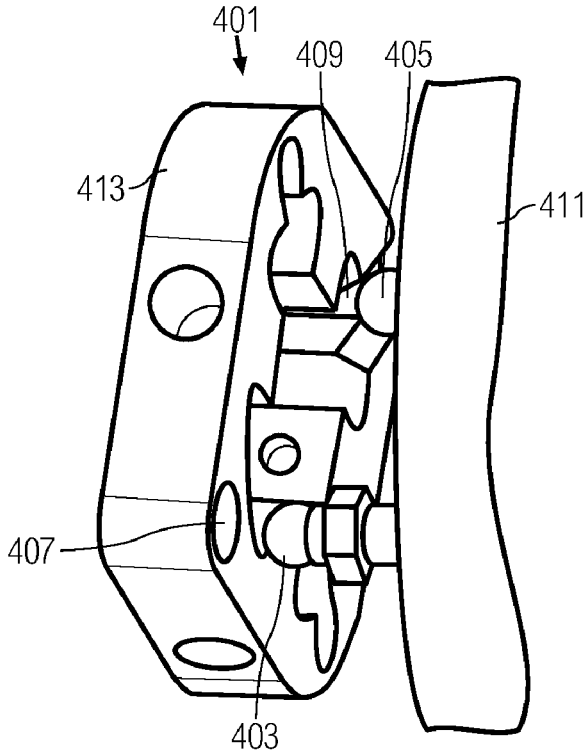
FIG. 8 shows the alignment mechanism of FIG. 5 with the quadrupole mass filter and middle quadrupole collision cell in a separated position.

FIG. 4 shows a close-up-view of the alignment mechanism 401 which provides precision alignment and positioning while allowing convenient assembly and disassembly of the components of the ion-optics 203. The alignment mechanism 401, is shown between the middle quadrupole collision cell 211 and the third quadrupole mass filter 213 within the cylindrical shroud 215. FIGS. 5 and 8 show detailed views of the alignment mechanism 401 alone.

The alignment mechanism 401 includes a first alignment pin 403 for engaging with a first socket 407 and a second alignment pin 405 for engaging with a second socket 409. The pins 403, 405 are shown to extend perpendicularly outward from a flange 411 which is in turn attached to the middle quadrupole collision cell 211. The sockets 407, 409 are formed within a flange 413 which is in turn attached to the cylindrical shroud 215.

In other embodiments, the pins 403, 405 can extend from the flange 413 and the sockets 407, 409 can be formed within the flange 411. Alternatively, the flanges 411, 413 can each include a combination of pins and sockets. There can also be any number of corresponding pins and sockets arranged on/within the flanges. In still other embodiments, the pins 403, 405 or sockets 407, 409 can be attached directly to or formed directly within a mass filter or collision cell portion of the ion-optics 203 without making use of the flanges 411, 413.

Another alignment mechanism is located at the opposite side of the middle quadrupole collision cell 211, between the middle quadrupole collision cell 211 and the first quadrupole mass filter 207, and can be substantially the same as embodiments described with respect to the alignment mechanism 401.

When manufacturing or first assembling the ion-optics 203, the alignment mechanism 401 is designed or adjusted to precisely control the alignment and position of the ion-optics 203 components relative to each other. The distances to which the pins 403, 405 extend perpendicularly outward from the flange 411 can be adjusted to achieve the desired relative axial position between the first quadrupole mass filter 207 and middle quadrupole collision cell 211. Also, the radial and tangential positioning of the pins 403, 405 can be adjusted to achieve the desired relative radial and tangential alignment.

Thus, the ion-optics components are brought into a predetermined axial positioning, radial alignment and tangential alignment.

Figure 6:
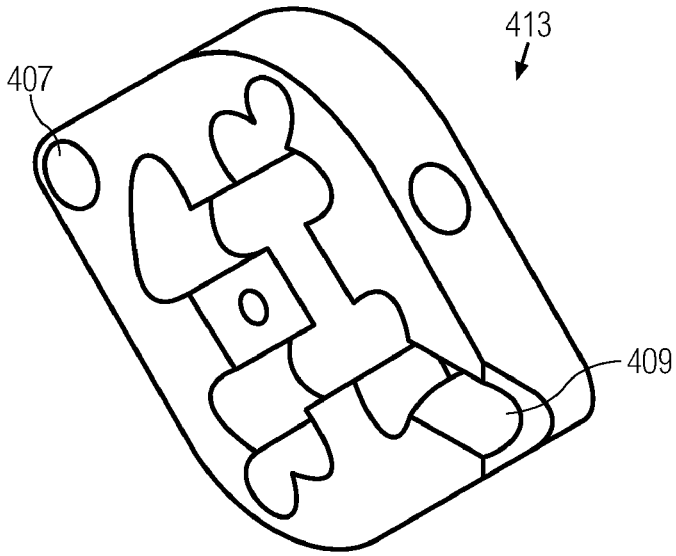
FIG. 6 shows a flange, of the alignment mechanism of FIG. 5, with sockets formed therein.
Figure 7:
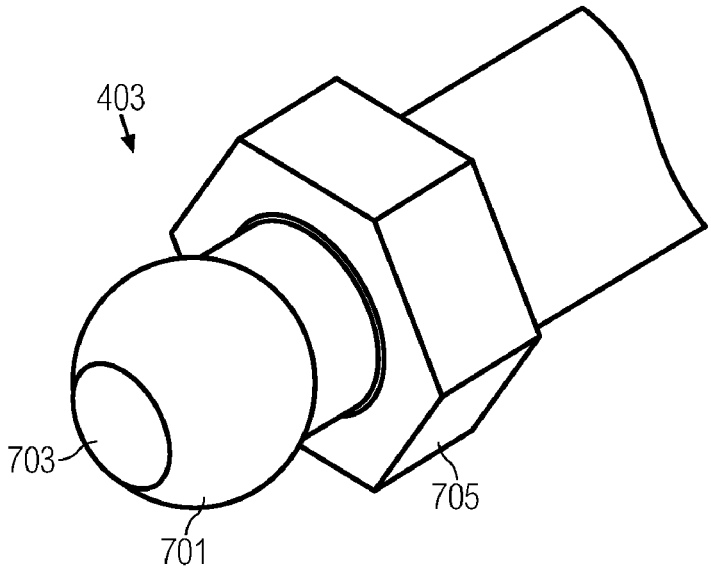
FIG. 7 shows a detailed view of an alignment pin of the alignment mechanism of FIG. 5.

FIG. 5 shows the alignment mechanism 401 when the third quadrupole mass filter 213 and middle quadrupole collision cell 211 are placed together. FIG. 6 shows the flange 413 with sockets 407, 409 formed therein. FIG. 7 shows a detailed view of the pin 403 (the other pins, for example the pin 405, can be substantially the same as the pin 403). The pin 403 has a generally rounded and spherical head 701 with a flattened top 703. The pin 403 also includes a spacer 705.

The fit between the pin 403 and first socket 407 and between the second pin 405 and second socket 409 is designed to have a tolerance of less than 0.5 millimeters. Thus the radial alignment (perpendicular to the beam path) between components is very precise. Also, as shown in FIG. 5, the relative axial position (in the direction of the beam path) of the components is precisely set by the spacer 705 buttressed against the flange 413 to within 0.5 millimeters of the design specifications. The other pins, similar to the pin 403, are also used to set the relative axial positions of the ion-optics 203 components.

Returning to FIG. 9, it can be seen that the pins 403, 405 support the middle quadrupole collision cell 211 by sitting in notches 901, 903 formed in the bracket 227. The other alignment mechanism is located between the middle quadrupole collision cell 211 and the first quadrupole mass filter 207 and has similar pins sitting on the bracket 225 to support the opposite end of the middle quadrupole collision cell 211.

Figure 10:
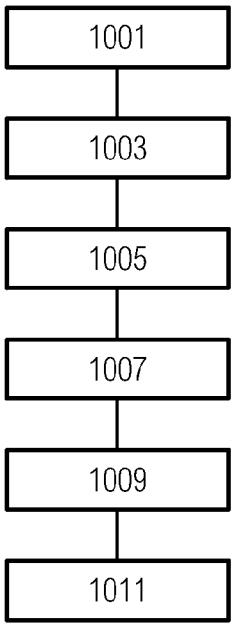
FIG. 10 illustrates steps for assembling and disassembling the ion-optics of a mass spectrometry system.

A method for assembling and disassembling the ion-optics 203 of the mass spectrometry system 201 is now described with reference to FIG. 10. At STEP 1001 the ion-optics 203 components are placed into the mass spectrometry system 201. With the panels 303, 305 in the open position as shown in FIG. 3, the ion source 205 and the first quadrupole mass filter 207 within the cylindrical shroud 209 (or more generally, a first section of the ion-optics) are mounted to, or fixed relative to, the panel 305 using brackets 221, 223. Also, the third quadrupole mass filter 213 within the cylindrical shroud 215 and the detector 217 (or more generally, a third section of the ion-optics) are mounted to, or fixed relative to, the panel 303 using brackets 229, 231. The middle quadrupole collision cell 211 (or more generally, a second section of the ion-optics) is mounted to the housing 301 using the brackets 225, 227. To this end, the middle quadrupole collision cell 211 is placed on top of the brackets 225, 227 such that the pins 403, 405 fit into the notches 901, 903 formed in the bracket 227 and also so that the similar pins at the opposite end of the middle quadrupole collision cell 211 fit into the similar notches formed in the bracket 225. Various electrical connections to the components of the ion-optics 203 are then made as is understood by those skilled in the art.

At STEP 1003 the panels 303, 305 are closed relative to the housing 301 of the mass spectrometry system 201. The panel 303 rotates about the hinge 307 so that the alignment mechanism 401, between the third quadrupole mass filter 213 and the middle quadrupole collision cell 211, brings together and aligns the third quadrupole mass filter 213 and middle quadrupole collision cell 211 (see FIGS. 4 and 8). The axis of rotation of the hinge 307 corresponds to the axial component of a cylindrical coordinate system. As the panel 303 rotates about the hinge 307, the pins 403, 405 of the alignment mechanism 401 travel along a tangentially directed path of this cylindrical coordinate system as they engage with the sockets 407, 409 of the alignment mechanism 401.

The socket 407 can have an approximately round cross section because it, and the pin 403, are further away from the hinge 307. On the other hand, the pin 405 and socket 409 are closer to the hinge 307 and in order to accommodate the more extreme tangential motion of the pin 405, the socket 409 has a cross-section elongated in the tangential direction compared to the cross-section of the socket 407. Additionally, designing the socket 407 to have an approximately round cross section and the socket 409 to have a cross-section elongated compared to the socket 407 helps to reduce tolerance stack-up.

When the panel 303 is in the closed position, the pins 403, 405 fit tightly into the sockets 407, 409 to provide close radial alignment between the middle quadrupole collision cell 211 and the first quadrupole mass filter 207. Moreover, when the panel 305 is in the closed position, the spacers 705 of the pins 403, 405 are buttressed against the flange 413 to provide precise axial positioning between the middle quadrupole collision cell 211 and the first quadrupole mass filter 207.

Also at STEP 1003, the closing of the panel 305 is accomplished in a manner similar to the closing of the panel 303 such that the panel 305 rotates about the hinge 309, thereby bringing the alignment mechanism between the first quadrupole mass filter 207 and the middle quadrupole collision cell 211 together to align the first quadrupole mass filter 207 and middle quadrupole collision cell 211.

As mentioned above with reference to FIG. 9, the middle quadrupole collision cell 211 loosely rests on the brackets 225, 227. Additionally, there is some play in the motion of the panels 303, 305 as they close. Thus, the ion source 205 and first quadrupole mass filter 207 mounted to the panel 305, the third quadrupole mass filter 213 and detector 217 mounted to the panel 303, and the middle quadrupole collision cell 211 resting on the brackets 225, 227, are all "floating" relative to each other.

The generally rounded and spherical shape of the heads of the pins 403, 405 of the alignment mechanisms serves to guide the "floating" components of the ion-optics 203 as the panels 303, 305 are closed to bring the alignment mechanisms together. As the panels 303, 305 reach the position where they are fully closed, the spacers 705 of the pins 403, 405 are buttressed against the flanges and the heads of the pins "snap" into their corresponding sockets so that the components of the ion-optics 203 are assembled into the predetermined alignment within a tolerance of less than approximately 0.5 mm in the radial and axial directions.

Additionally, the amount of play between the ion source 205 and first quadrupole mass filter 207 mounted to the panel 305, the third quadrupole mass filter 213 and detector 217 mounted to the panel 303, and the middle quadrupole collision cell 211 resting on the brackets 225, 227 is not so much that the pins and corresponding sockets miss engaging with each other upon closing the panels 303, 305.

At STEP 1005 vacuum chambers of the mass spectrometry system 201 are pumped down, the mass spectrometry system 201 is turned on and can then be used to perform a measurement on a sample.

The measurement of a sample can be performed by ionizing the sample using the ion source 205 to transform the molecules in the sample into ions. Gas, such as helium, is also pumped into the source 205. The mass analyzer portion of the ion-optics 203 then sorts the ions by their masses by applying electric and magnetic fields. The detector 317 of the ion-optics 203 measures the value of some indicator quantity and thus provides data for calculating the abundances of each ion present.

When maintenance is required, at STEP 1007 the vacuum in the housing 301 is released and the mass spectrometry system 201 is turned off.

At STEP 1009 the panels 303, 305 are opened. When this is done the pins and sockets disengage from each other and the ion source 205, first quadrupole mass filter 207, and cylindrical shroud 209 are separated from the middle quadrupole collision cell 211. Also the third quadrupole mass filter 213, cylindrical shroud 215, and detector 217 are separated from the middle quadrupole collision cell 211.

At STEP 1011 it is a simple matter for a user to manually remove the mass spectrometer components internal to the housing 301, for example the ion-optics 203, in order to perform cleaning, repair, or regular periodic maintenance.

In the foregoing specification, the invention has been described with reference to specific exemplary embodiments thereof. The specification and drawings are, accordingly, to be regarded in an illustrative sense rather than a restrictive sense.

The invention claimed is:

1. A mass spectrometry system comprising:

ion-optics;

a housing for the ion-optics;

a panel movable between an open and closed position relative to the housing;

wherein a first section of the ion-optics is within the housing, a second section of the ion-optics is mounted to the panel, wherein the first and second sections of the ion-optics are within a single vacuum chamber, and are surrounded by the housing and the panel when the panel is in the closed position; and an alignment mechanism for aligning the first and second sections of the ion-optics into a pre-determined alignment upon closing the panel.

2. The system of claim 1, wherein the first section of the ion-optics is mounted to the housing.

3. The system of claim 1, further comprising at least one bracket attached to the housing upon which the first section of the ion-optics sits in order to mount the first section of the ion-optics to the housing.

4. The system of claim 1, further comprising at least one bracket attached to the panel and supporting the second section of the ion-optics to mount the second section of the ion-optics to the housing.

5. The system of claim 1, wherein the alignment tolerance of the pre-determined alignment of the first section of the ion-optics and the second section of the ion-optics is less than 0.5 millimeters.

6. The system of claim 1, wherein the panel rotates about a hinge when moving between the open and closed positions.

7. The system of claim 1 wherein the panel rotates about a hinge when moving between the open and closed positions and wherein the alignment mechanism comprises pins and sockets, said pins being present on one of the first and second sections the ion-optics and said sockets being present on the other of the first and second sections of the ion-optics, for moving into engagement with each other to align the first and second sections into the pre-determined alignment upon closing the panel.

8. The system of claim 7, further comprising:

a flange of one of the first and second sections from which the pins extend toward the other section; and a flange of the other section into which the sockets are formed.

9. The system of claim 7, wherein at least one of the pins comprises a spacer for setting a pre-determined distance between the first section of the ion-optics and the second section of the ion-optics when the panel is moved to the closed position and the pins and sockets move into engagement with each other.

10. The system of claim 7, wherein the panel rotates about a hinge when moving between the open and closed positions and wherein a socket closer to the hinge has an approximately round cross-section while a socket further from the hinge has a has an elongated cross-section relative to that of the socket closer to the hinge.

11. The system of claim 10, wherein at least one of the pins has a rounded head and tangentially rotates about the hinge into engagement with at least one of the sockets.

12. The system of claim 1, wherein the first section of the ion-optics includes a collision cell.

13. The system of claim 1, wherein the second section of the ion-optics includes a mass filter.

14. A method for aligning ion-optics of a mass spectrometry system comprising the step of:

closing a panel to which a second section of the ion-optics is attached so that an alignment mechanism brings the second section of the ion-optics into a pre-determined alignment with a first section of the ion-optics mounted within a housing wherein the first and second sections are housed in a single vacuum chamber.

15. The method of claim 14, wherein the first section of the ion-optics is mounted to the housing.

16. The method of claim 14, wherein the alignment tolerance of the pre-determined alignment of the first section of the ion-optics and the second section of the ion-optics is less than 0.5 millimeters.

17. The method of claim 14, wherein the alignment mechanism comprises pins and sockets and the closing step further comprises moving the pins and sockets into engagement with each other to align the first and second sections into the pre-determined alignment upon closing the panel and wherein the closing step further comprises rotating the panel about a hinge.

18. The method of claim 17, wherein at least one of the pins comprises a spacer and wherein the step of closing the panel further comprises bringing the first section of the ion-optics and the second section of the ion-optics to within a pre-determined distance of each other, set by the spacer, when the panel is moved to the closed position and the pins and sockets move into engagement with each other.

19. The method of claim 15, wherein prior to the step of closing the panel, a step is performed to mount the first section of the ion-optics to the housing by placing the first section of the ion-optics on at least one bracket.

* * * * *

UNITED STATES PATENT AND TRADEMARK OFFICE

CERTIFICATE OF CORRECTION

PATENT NO. : 8,093,551 B2
APPLICATION NO. : 12/492159
DATED : January 10, 2012
INVENTOR(S) : Douglas J. King It is certified that error appears in the above-identified patent and that said Letters Patent is hereby corrected as shown below:

In column 7, line 54, in Claim 7, after “sections” insert -- of --.

In column 8, lines 15-16, in Claim 10, delete “has a has an” and insert -- has an --, therefor.

Signed and Sealed this
Seventeenth Day of April, 2012

David J. Kappos

David J. Kappos
*Director of the United States Patent and Trademark Office*